US009244388B2

(12) United States Patent
Berger et al.

(10) Patent No.: US 9,244,388 B2
(45) Date of Patent: Jan. 26, 2016

(54) ROLLER WITH NON-UNIFORM DIAMETER

(75) Inventors: Shachar Berger, Nes Ziona (IL); Zvika Cohen, Nes Ziona (IL); Oran Levintant, San Diego, CA (US)

(73) Assignee: Hewlett-Packard Indigo B.V., Maastricht (NL)

( * ) Notice: Subject to any disclaimer, the term of this patent is extended or adjusted under 35 U.S.C. 154(b) by 59 days.

(21) Appl. No.: 14/007,104

(22) PCT Filed: Mar. 30, 2011

(86) PCT No.: PCT/EP2011/054892

§ 371 (c)(1), (2), (4) Date: Sep. 24, 2013

(87) PCT Pub. No.: WO2012/130295

PCT Pub. Date: Oct. 4, 2012

(65) Prior Publication Data

US 2014/0023400 A1 Jan. 23, 2014

(51) Int. Cl.

| | |
|---|---|
| ***G03G 15/10*** | (2006.01) |
| ***G03G 15/08*** | (2006.01) |
| ***G03G 15/11*** | (2006.01) |

(52) U.S. Cl.
CPC ..... *G03G 15/10* (2013.01); *G03G 15/0812* (2013.01); *G03G 15/11* (2013.01)

(58) Field of Classification Search
CPC ..... G03G 15/0806; G03G 15/0808; G03G 15/0813; G03G 15/10; G03G 15/11
USPC ..... 399/239, 307
See application file for complete search history.

(56) References Cited

U.S. PATENT DOCUMENTS

| | | | | |
|---|---|---|---|---|
| 5,689,788 | A * | 11/1997 | Moser | 399/328 |
| 5,854,960 | A * | 12/1998 | Tagansky et al. | 399/239 |
| 6,072,977 | A * | 6/2000 | Murakami | 399/313 |
| 6,078,774 | A * | 6/2000 | Kim et al. | 399/307 |
| 2005/0008402 | A1 * | 1/2005 | Mizutani et al. | 399/281 |

FOREIGN PATENT DOCUMENTS

| | | | |
|---|---|---|---|
| EP | 1582937 | A1 | 10/2005 |
| JP | 2010145899 | A | 7/2010 |
| WO | WO-9613761 | A1 | 5/1996 |

* cited by examiner

*Primary Examiner* — Quana M Grainger

(57) ABSTRACT

In an example, rollers are disclosed, wherein one of the rollers has a resilient outer layer, and one of the rollers comprises a coned portion.

20 Claims, 5 Drawing Sheets

*Fig. 4*
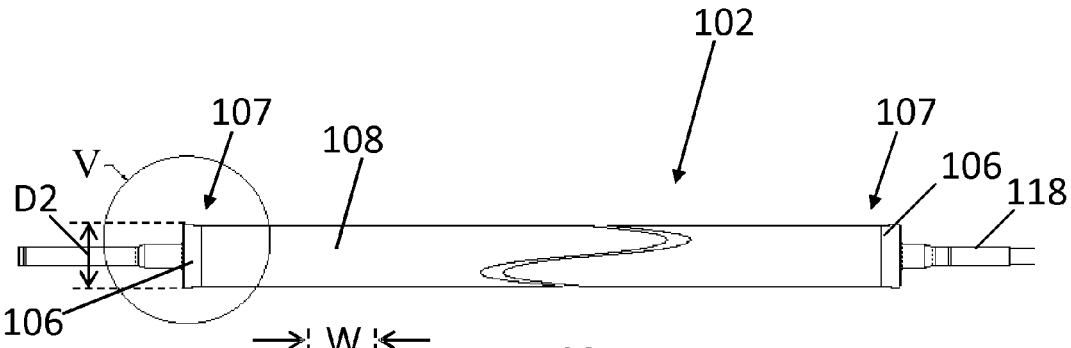
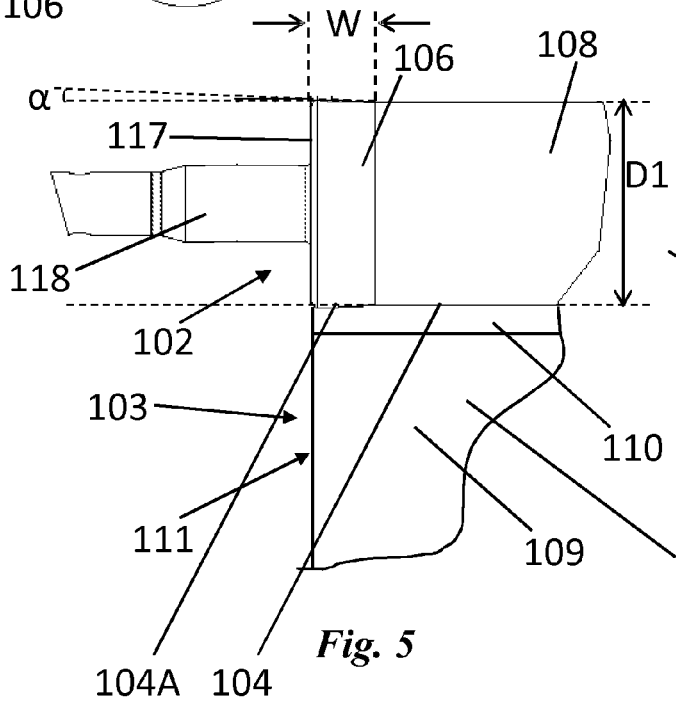
*Fig. 5*
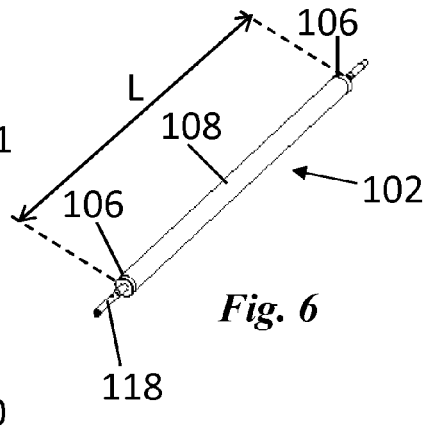
*Fig. 6*

ROLLER WITH NON-UNIFORM DIAMETER

BACKGROUND OF THE INVENTION

Certain embodiments of roller arrangements are arranged to process substances through nips between their rollers. A substance feed arrangement feeds the substance to the nip.

BRIEF DESCRIPTION OF THE DRAWINGS

For the purpose of illustration, certain embodiments of the present invention will now be described with reference to the accompanying diagrammatic drawings, in which:

FIG. 4 shows a front view of an embodiment of a squeegee roller;

FIG. 5 shows a more detailed front view of a coned portion of the embodiment of FIG. 4;

FIG. 6 shows a perspective view of the embodiment of the squeegee roller of FIGS. 4 and 5;

DETAILED DESCRIPTION

In the following detailed description, reference is made to the accompanying drawings. The embodiments in the description and drawings should be considered illustrative and are not to be considered as limiting to the specific embodiment of element described. Multiple embodiments may be derived from the following description and/or drawings through modification, combination or variation of certain elements. Furthermore, it may be understood that also embodiments or elements that are not literally disclosed may be derived from the description and drawings by a person skilled in the art.

Figure 1:
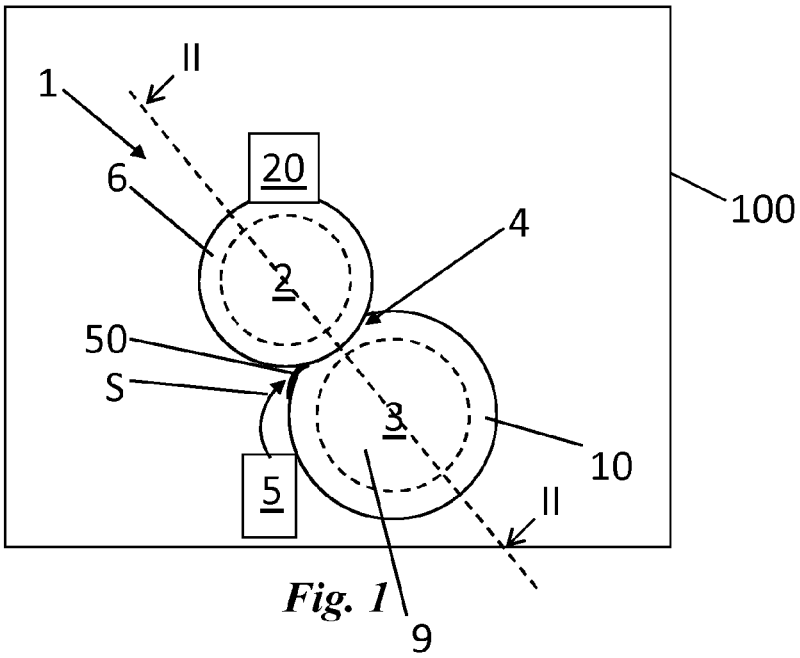
FIG. 1 shows a diagram of an embodiment of a roller arrangement in a side view.
Figure 2:
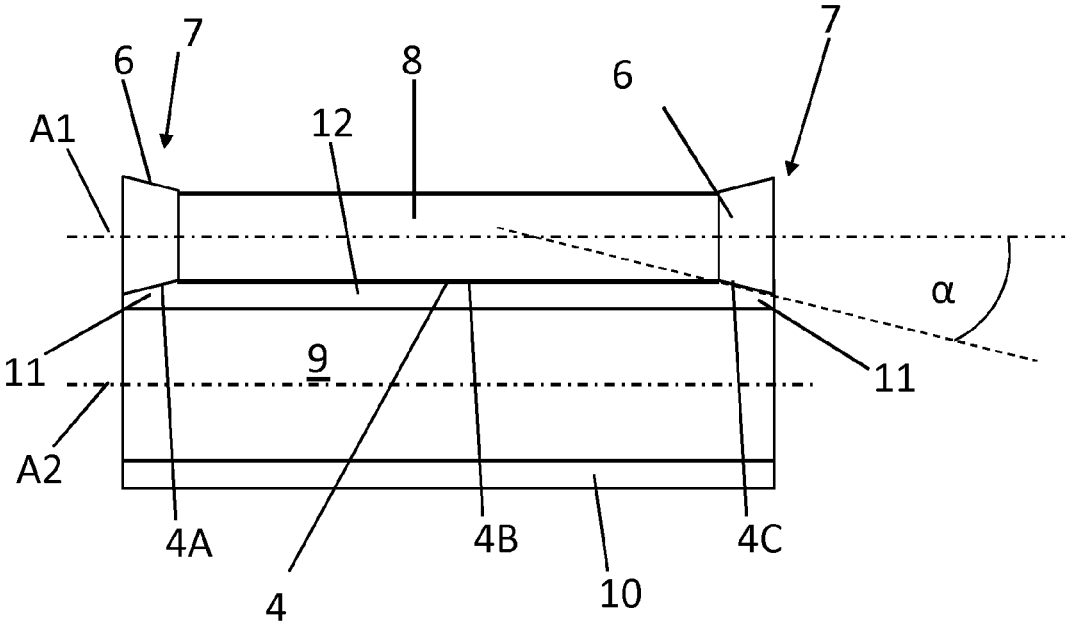
FIG. 2 shows a cross sectional view of the embodiment of FIG. 1, along section line II-II.

FIGS. 1 and 2 show diagrams of an embodiment of a roller arrangement 1. The dimensions of the elements in these figures may be exaggerated for reasons of illustration. The roller arrangement 1 of FIG. 1 comprises a first roller 2, and a second roller 3. A nip 4 is provided between the rollers 2, 3. A substance feed arrangement 5 is provided for feeding a substance 50 in a direction S, to the nip 4. The substance 50 is pressed through the nip 4 by a rotational movement of the rollers 2, 3. One of the rollers 2, 3 comprises a resilient outer layer 10. Another one of the rollers 2, 3 comprises a stiff outer layer.

The nip 4 is the area or volume where a stiff roller partly sinks into the resilient outer layer 10 of the other roller, for example where the first roller 2 sinks into the second roller 3, respectively. In operation, the substance 50 may press through the nip 4 by rotation of the respective rollers 2, 3, being pressurized between the rollers 2, 3. In certain embodiments, the nip 4 comprises a gap, and in operation the resilient outer layer 10 may deform when the substance 50 is pressed through. In an embodiment, the rollers 2, 3 are arranged to exert an approximately equal pressure onto the substance 50 along the nip 4.

For example, the roller arrangement 1 comprises a pressure arrangement 20 for pressurizing the substance 50 against a roller 2, 3. In a further example, the pressure arrangement 20 is arranged to press the first roller 2 against the second roller 3. The pressure arrangement 20 may comprise a spring, resilient material, an electromotor, an actuator or any other suitable pressure means. In other embodiments, the rollers 2, 3 have a fixed axis position, and the pressure is exerted by the resilience of the resilient outer layer 10. Not necessarily a separate pressure arrangement 20 is provided.

The roller arrangement 1 shown in the example of FIG. 1 is part of a substance processing device 100. In a further example, the substance processing device 100 may be a printer and the substance 50 may comprise ink or toner. In an embodiment the substance processing device 100 comprises an electrophotographic printer for printing liquid or dry toner onto certain media such as paper. Examples of a printer also include a copy device and a press.

FIG. 2 shows a diagrammatic cross sectional view of the roller arrangement 1 of FIG. 1 along section line II-II. The first roller 2 comprises two coned portions 6. The coned portions 6 are arranged at the respective ends 4A, 4C of the nip 4, on both sides of a middle portion 4B of the nip 4. In the shown example, the coned portions 6 are arranged at the respective end portions 7 of the first roller 2, on both sides of a middle portion 8 of the first roller 2.

The coned portions 6 are arranged so that a diameter of the respective roller 2 increases towards an end 4A, 4C of the nip 4. In the shown example, the surface of the coned portion 6 is inclined under an angle $\alpha$, with respect to its central axis. In the shown example, the coned portions 6 are inclined with respect to the surface of the second roller 3. In the shown embodiment, the coned portions 6 comprise a relatively straight inclination of the surface of the roller 2. In other embodiments, the coned portions 6 may comprise a convex or concave surface shape. Also combinations or more complex shapes may be applied.

In the shown example, the second roller 3 comprises a core 9 and a resilient outer layer 10 that is applied around the core 9. In operation, a relatively equal pressure may be exerted onto the substance 50 by the rollers 2, 3, with the aid of the coned portions 6. The coned portions 6 may compensate for an increased deformation of the resilient outer layer 10 at the end portions 11 of the resilient outer layer 10, near the ends 4A, 4C of the nip 4. In an example, the coned shape of the coned portions 6 provides for a additional pressure near the ends 4A, 4C of the nip 4, compensating for the increased deformation that takes place at the end portions 11 of the resilient outer layer 10. A relatively equal pressure on the substance 50 in the nip 4, may spread the substance 50 relatively equally along the nip 4.

In an embodiment, the substance 50 comprises a liquid, and the substance feed arrangement 5 is arranged to feed liquid. In another embodiment, the substance 50 comprises toner and the substance feed arrangement 5 is arranged to feed toner. In again another embodiment, the substance 50 comprises liquid toner and the substance feed arrangement 5 is arranged to feed liquid toner.

In an embodiment, the second roller 3 comprises a developer roller. In a further embodiment, the developer roller has a substantially cylindrical shape, at least along the nip 4. A material of the resilient outer layer 10 of the second roller 3 may comprise an elastomer such as polyurethane or rubber. In certain embodiments, at least one coating or additional outer layer may be applied onto the resilient outer layer 10.

The first roller 2 may comprise a relatively non-resilient or stiff material such as metal. In a further embodiment, the first roller 2 is provided with the coned portions 6 at each end portion 7 of the roller 2. In an embodiment, the first roller 2 comprises a squeegee roller, arranged to squeeze liquid toner along the resilient outer layer 10 of the developer roller, with a substantially equal force along the nip 4. The coned portions 6 aid in providing the substantially equal force along the nip 4.

In an embodiment, the surface of the coned portion 6 has an angle α of between approximately 0.2 and approximately 10° with respect to the central axis A1 of the first roller 2. For example, the coned portion 6 has an angle α of between approximately 0.3 and approximately 6° with respect to the central axis A1 of the first roller 2. For example, the angle α of the coned portion 6 may be predetermined based on a desired pressure to be applied to the substance 50 in the nip 4. For example, if the pressure between the rollers 2, 3 is higher, the angle α may be chosen to be smaller. The angle α may also be chosen to vary along the coned portion 6. For example, the coned portion 6 may comprise a concave and/or convex shape. In an embodiment, a portion of the surface of the coned portion 6 may have an angle α that exceeds above mentioned range.

Figure 3:
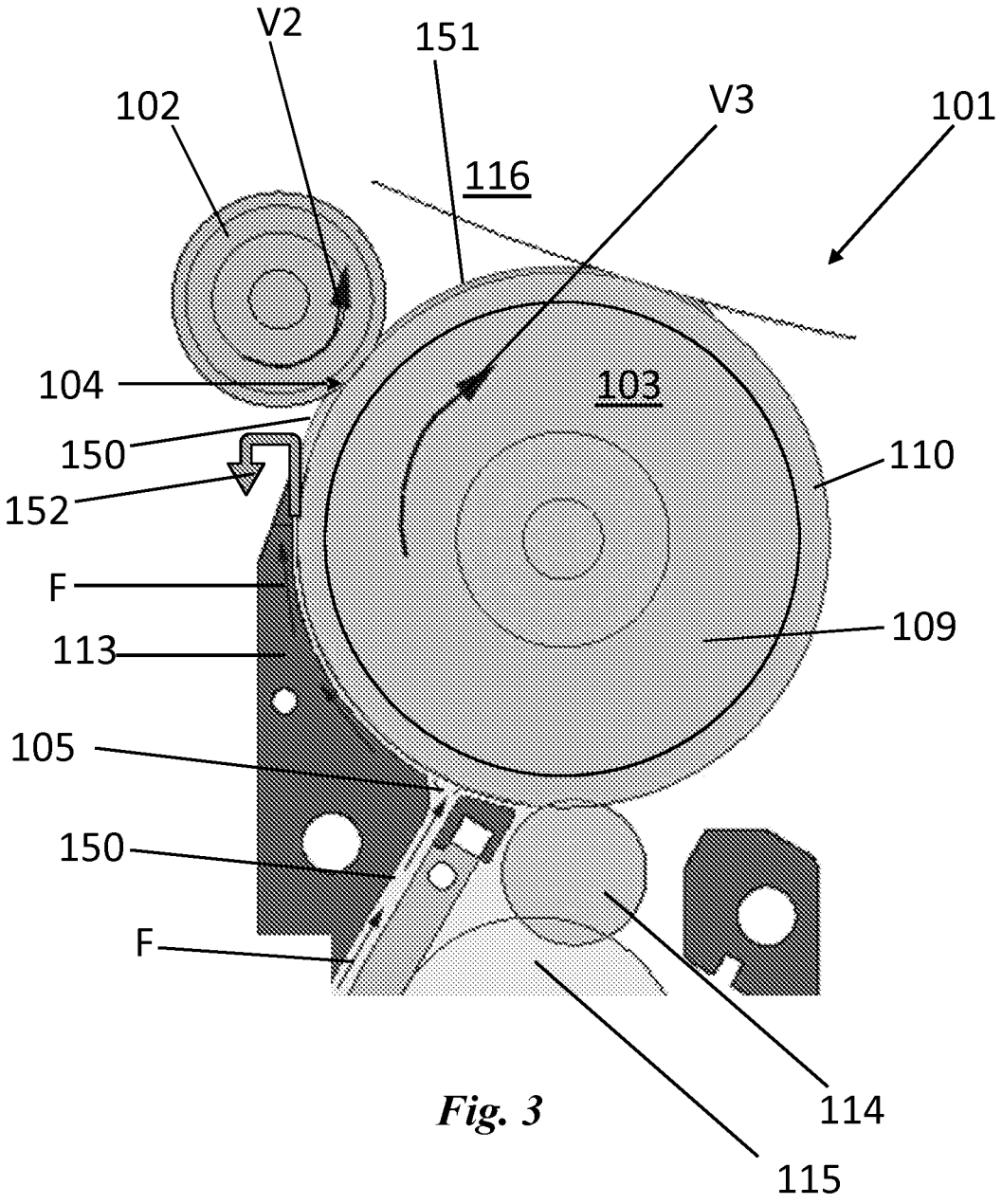
FIG. 3 shows a diagram of an embodiment of a developer arrangement.

FIG. 3 shows a diagram of an embodiment of a developer arrangement 101 in side view. The developer arrangement 101 may be part of an electrophotographic printer. The developer arrangement 101 may be arranged for processing liquid or dry toner. The shown embodiment may be part of a liquid electrophotographic printer for processing liquid toner 150.

The developer arrangement 101 comprises a squeegee roller 102 and a developer roller 103. A nip 104 is provided between the two rollers 102, 103. The developer arrangement 101 comprises an electrode 113 for charging the toner 150, and an inlet 105 for providing the toner 150 to the developer roller 103. The electrode 113 may be a main electrode for charging the toner 150. Further parts of the developer arrangement 101 include a cleaner roller 114 and a sponge roller 115. The developer roller 103 comprises a core 109 and a resilient outer layer 110. The resilient outer layer 110 may comprise an elastomeric material such as rubber and/or polyurethane. In a further embodiment, the developer roller 103 transfers fused toner to an image transfer roller 116, of which a part of the surface is shown in FIG. 3.

Several parts of the developer arrangement 101 are charged for processing the toner 150. In certain illustrative examples, at least a part of the electrode 113 is charged with approximately −1500 Volts, at least a part of the cleaner roller 114 with approximately −240 Volts, at least a part of the developer roller 103 with approximately −500 Volts, at least a part of the squeegee roller 102 with approximately −800 Volts, and at least a part of the image transfer roller 116 with approximately −350 to −600 Volts. The developer roller 103 may have a charged core 109. The core 109 may comprise a chargeable material such as metal. The squeegee roller 102 may comprise a chargeable material such as metal.

FIG. 3 shows an example of a flow direction F of the toner 150. Also examples of a rotational movement direction V2, V3 of the squeegee roller 102 and the developer roller 109, respectively, are shown. The toner 150 flows along the electrode 113, where it is charged. The toner 150 may be applied to the developer roller 103 because of electric field between the electrode 113 and the developer roller 103. The squeegee roller 102 force squeezes the toner 150 against the resilient outer layer 110 of the developer roller 103. For example, a thin layer of toner 151 is force squeezed against the developer roller 103. A substantial part of this thin layer 151 is properly fused. A top layer 152 that comprises unfused toner 152 may not pass through the nip 104 and may be returned, for example to an ink tank. The fused toner 150 may be relatively uniformly spread over the developer roller 103 through the pressurization between the rollers 102, 103, so that it can be transferred to the image transfer roller 116 relatively uniformly. In an example, this may contribute in providing a desired image quality, also near edges of a respective print medium.

FIGS. 4-6 show an example of a squeegee roller 102. FIG. 4 shows a squeegee roller 102 in front view. FIG. 5 shows an end portion 107 of the squeegee roller 102 of FIG. 4, in front view. For illustration, a diagram of a detail of an engaging end portion 111 of a developer roller 103 is also illustrated in FIG. 5. FIG. 6 shows a perspective view of the squeegee roller 102 of FIGS. 4 and 5. FIGS. 4-6 illustrate an example of a squeegee roller 102 that is arranged with coned portions 106. For example, in operation, the coned portions 106 may increase the pressure near respective ends 104A of the nip 104 to prevent that too much unfused toner passes through the nip 104.

In the shown example the length L of the squeezing part of the squeegee roller 102 is approximately 338 mm (millimeters). For this embodiment, the length of the nip 104 may be 338 mm or less. For example, the length of the nip 104 may depend on the engaging length of the developer roller 103. For example, the length of the developer roller 103 and nip 104 is approximately 332 mm. In the shown example, the width of the coned portion 106, as measured along the length of the squeegee roller 102, is approximately 5 mm, with a tolerance of approximately 0.1 mm. In the shown example, the coned portion 106 has a width W that is approximately 1.3% of the total length L of the squeezing part of the squeegee roller 102/nip 104. For example, each coned portion 106 may have a width W that is between approximately 0.5 and approximately 2% of the total length L of the squeezing part of the squeegee roller 102/nip 104. The shown squeegee roller 102 includes a chamfered portion 117 and an axle 118 near the end portions 107. In an example, these parts 117, 118 extend outside of the nip 104. In certain examples, the coned portions 106 may also partly extend outside of the nip 104.

In the shown example, the diameter D1 of the squeegee roller 102 is approximately 16 mm at the mid portion 108. The diameter D2 of the squeegee roller 102 at the end 107 of the coned portion 106 is approximately 16.5 mm. The angle α of the surface of the coned portion 106 with respect to the central axis, or with respect to the mid portion 108, is approximately 2.86°. For example, the angle α of other squeegee roller examples may be adapted to be within a range of between approximately 0.2 and approximately 5°, or up to approximately 10°.

In other embodiments the length L may of a respective roller 2, 102 with coned portions 106 may for example be in a range of between approximately 0.1 and approximately 6 m (meters). The width W of the coned portion 106 of the respective roller 102 may for example be within a range of between approximately 0.2 and 20% of the total length of the nip 104, or for example within a range of between approximately 0.2 and 5% of the total length of the nip 104.

It is noted that the roller discussed with reference to FIGS. 4-6 could be another type of roller than a squeegee roller 102. The features and dimensions of the squeegee roller 102 of FIGS. 4-6 may also apply to other types of rollers 2 with coned portions 6.

Figure 7:
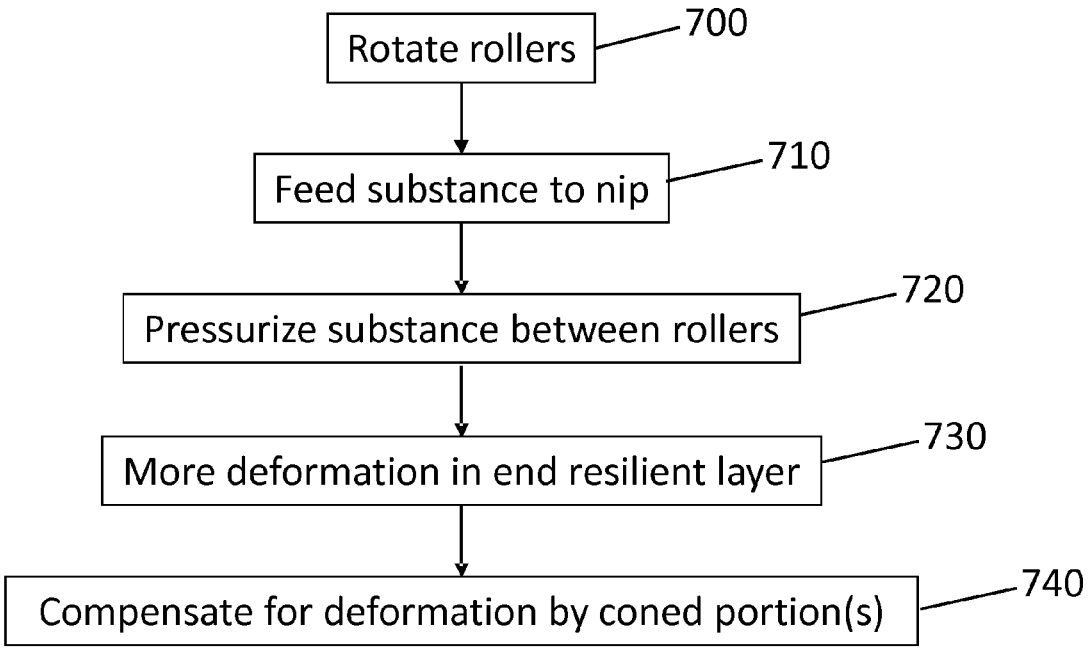
FIG. 7 shows a flow chart of an embodiment of feeding a substance to a nip.

FIG. 7 shows a flow chart of an example of a method of feeding a substance 50 to a nip 4, 104 between two rollers 2, 3, 102, 103. In a first block 700, the rollers 2, 3, 102, 103 are rotated. For example the rollers 2, 3, 102, 103 are rotated in a direction V2, V3, respectively. In a second block 710, the substance 50 is fed to the nip 4, 104. For example, the substance 50 comprises toner 150. In a third block 720, the substance 50 is pressurized between the rollers 2, 3, 102, 103, for spreading a part of the substance 50 along the nip 4, 104. For example, the toner 150 is squeezed against the developer roller 103 with the squeegee roller 102. In a fourth block 730, an end portion 11, 111 of the resilient outer layer 10, 110 deforms more than a middle portion 12. This may be due to an increased deflection of the resilient material at the end portions 11, 111, where it is not supported by the squeegee roller 2, 102. For example, a diameter of the resilient outer layer 10, 110 in the end portion 11, 111 may decrease more in the end portion 11, 111 than in the middle portion 12. The coned portion 6, 106 compensates for the increased deformation of the end portion 11, 111, as shown by a fifth block 740. The increased diameter of the coned portion 6, 106 may provide for additional pressure in the ends 4A, 4C of the nip 4, 104, so that the pressure on the substance 50, along the entire nip 4, 104, may be more uniform. In an embodiment, this may allow for a relatively uniform spread of the substance 50 along the nip 4, 104.

Figure 8:
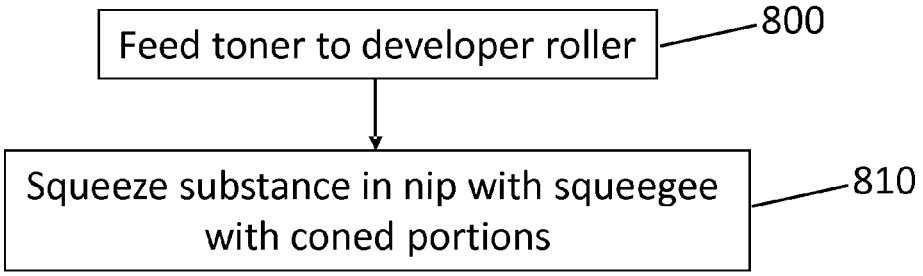
FIG. 8 shows a flow chart of an embodiment of squeezing liquid toner in a nip.

A further example of a method of feeding a substance 50 to a nip 104 between two rollers 102, 103 is shown in a flow chart in FIG. 8. In a first block 800, toner 150 is fed to the developer roller 103. In a second block 810, the toner 150 is squeezed against the developer roller 103, with the squeegee roller 102, comprising coned portions 106. In an example, the toner 150 comprises liquid toner. In this embodiment, use of the coned portions 106 may allow for a relatively uniform spread of the toner 150 over the developer roller 103, and prevent that too much un-fused toner flows through the nip 104 near the ends 104A, 104C of the nip 104.

Figure 9:
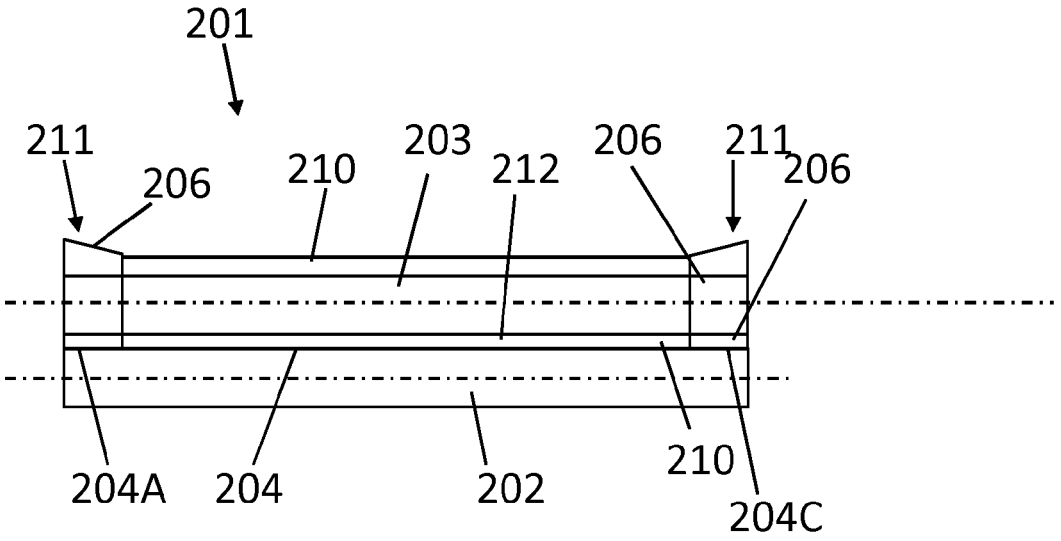
FIG. 9 shows a cross sectional diagram of another embodiment of a roller arrangement.

FIG. 9 shows another embodiment of a roller arrangement 202, wherein a second roller 203 with a resilient outer layer 210 comprises coned portions 206 at the end portions 211. The first roller 202 has a cylindrical shape along the nip 204. In such embodiment the coned portions 206 of the second roller 203 may compensate for the increased deformation of its resilient outer layer 210 near its end portions 211 with respect to the deformation in the middle portion 212 of its resilient outer layer 210.

In further embodiments (not shown), both rollers 2, 102, 202, 3, 103, 203 are provided with coned portions 6, 106, 206 near the respective ends 4A, 4C, 104A, 204A, 204C of the nip 4, 104, 204. In certain embodiments, a respective roller comprises only one coned portion 6, 106, 206.

In certain embodiments, the roller having the resilient outer layer 10, 110, 210 has a resilient core and/or substantially consists of resilient material.

In certain embodiments, the substance 50 may comprise any suitable dry or wet substance, liquid, powder, granular material, medium, mixture, emulsion, etc. In addition to developing, fusing and/or printing, other processes that comprise feeding a substance 50 to a nip 4, 104, 204 between rollers 2, 102, 202, 3, 103, 203 may be suitable to use a roller arrangement 1, 101, 201 according to this disclosure.

The above description is not intended to be exhaustive or to limit the invention to the embodiments disclosed. Other variations to the disclosed embodiments can be understood and effected by those skilled in the art in practicing the claimed invention, from a study of the drawings, the disclosure, and the appended claims. The indefinite article "a" or "an" does not exclude a plurality, while a reference to a certain number of elements does not exclude the possibility of having more or less elements. A single unit may fulfil the functions of several items recited in the disclosure, and vice versa several items may fulfil the function of one unit. Multiple alternatives, equivalents, variations and combinations may be made without departing from the scope of the invention.

The invention claimed is:

1. Roller arrangement, comprising:

first and second rollers, one of the rollers having a resilient outer layer, a nip between the first and second rollers, and a substance feed arrangement for feeding substance to the nip, wherein the first and second rollers each have a central axis, the central axis of the first roller and the central axis of the second roller are parallel, a separation between the central axis of the first roller and the central axis of the second roller is static, each roller has a central portion of uniform diameter, the rollers are arranged to equally spread the substance along the nip, the first roller has a coned portion, near an end of the nip, to compensate for an increased deformation of the resilient outer layer near the end of the nip, and the second roller having a corresponding portion corresponding with the coned portion of the first roller, wherein the corresponding portion of the second roller has a diameter that is at least as great as the uniform diameter of the central portion of the second roller.

2. Roller arrangement according to claim 1, wherein the coned portion has an inclined surface with respect to the opposite roller.

3. Roller arrangement according to claim 1, wherein the substance feed arrangement is arranged to feed liquid.

4. Roller arrangement according to claim 1, wherein the substance feed arrangement is arranged to feed toner.

5. Roller arrangement according to claim 1, wherein the roller with the resilient outer layer is a developer roller.

6. Roller arrangement according to claim 4, wherein the developer roller has a substantially cylindrical shape along the nip.

7. Roller arrangement according to claim 1, wherein the resilient outer layer comprises an elastomer.

8. Roller arrangement according to claim 1, wherein one of the rollers comprises a squeegee roller, and the squeegee roller is provided with said coned portion at each end.

9. Roller arrangement according to claim 1, wherein the coned portion has an angle of between approximately 0.2° and approximately 10° with respect to the central axis of the respective roller.

10. Developer arrangement comprising a roller arrangement according to claim 1.

11. Electro-photographic printer comprising a roller arrangement according to claim 1.

12. Method of feeding substance to a nip between two rollers, wherein one of the rollers has a resilient outer layer, and one of the rollers comprises a coned portion, near an end of the nip, comprising feeding the substance to the nip, pressurizing the substance with the rollers for spreading the substance along the nip, an end portion of the resilient outer layer deforming more than a mid portion due to the pressure, and using the coned portion to compensate for the deformation of the end portion, wherein a depth of the nip is non-uniform over a length of the rollers.

13. Method according to claim 12, wherein the substance comprises toner, one of the rollers comprises a developer roller, one of the rollers comprises a squeegee roller, the method comprising squeezing the toner against the developer roller with the squeegee roller.

14. Method according to claim 12, wherein the substances comprises liquid toner.

15. Roller arrangement, comprising a first roller having a uniform diameter over an entire length of the first roller, a second roller having a uniform diameter over a central portion of the roller, a nip between the first and second roller, and a substance feed arrangement for feeding substance to the nip, wherein one of the rollers comprises a resilient outer layer, and wherein a portion of the second roller has a diameter that increases towards an end of the nip to compensate for an increased deformation of the resilient outer layer near the end of the nip.

16. Roller arrangement according to claim 1, wherein the coned portion is concave.

17. Roller arrangement according to claim 1, wherein the coned portion is convex.

18. Roller arrangement according to claim 1, wherein the coned portion has a constant slope with respect to the central axis of the first roller, the slope being between approximately 0.2° and approximately 5°.

19. Roller arrangement according to claim 1, wherein the coned portion is between approximately 0.5% and approximately 2% of a length of the nip.

20. Roller arrangement according to claim 1, wherein the first roller has a coned portion on each end.

* * * * *